US007243962B2

(12) United States Patent
Stolzman

(10) Patent No.: US 7,243,962 B2
(45) Date of Patent: Jul. 17, 2007

(54) ONE PIECE LOCKING BELT

(76) Inventor: Michael D. Stolzman, c/o International Precision Components Corp., 26468 N. Ballard Dr., Lake Forest, IL (US) 60045

( * ) Notice: Subject to any disclaimer, the term of this patent is extended or adjusted under 35 U.S.C. 154(b) by 0 days.

(21) Appl. No.: 10/985,521

(22) Filed: Nov. 9, 2004

(65) Prior Publication Data

US 2006/0097524 A1 May 11, 2006

(51) Int. Cl.
*B65D 45/30* (2006.01)

(52) U.S. Cl. ..... 292/256.69; 292/256.65; 292/317

(58) Field of Classification Search ..... 292/256.69, 292/256.65 X, 256.63, 256.6, 243, 245, 317 X, 292/256, 256.75, 258, 288, 299, DIG. 11, 292/DIG. 49; 220/321, 320; 403/388; 24/17 AB, 24/16 PB, 20 EE, 23 EE, 22 X, 23 R
See application file for complete search history.

(56) References Cited

U.S. PATENT DOCUMENTS

| | | | | | |
|---|---|---|---|---|---|
| 360,770 | A * | 4/1887 | Gardner | 132/71.1 |
| 3,070,397 | A * | 12/1962 | Rodish | 292/256.69 |
| 3,261,632 | A * | 7/1966 | Schaefer | 292/256.69 |
| 3,458,217 | A * | 7/1969 | Pride, Jr. et al. | 285/3 |
| 3,556,575 | A * | 1/1971 | Farkas | 292/307 R |
| 3,637,257 | A * | 1/1972 | Uncapher | 292/256.69 |
| 3,790,020 | A * | 2/1974 | Fine | 220/319 |
| 3,861,723 | A * | 1/1975 | Kunz et al. | 285/410 |
| 3,897,884 | A * | 8/1975 | Lankenau | 220/320 |
| 4,197,982 | A * | 4/1980 | de Lima Castro Netto | 383/71 |
| 5,085,476 | A * | 2/1992 | Fuehrer | 292/307 R |
| 5,129,537 | A | 7/1992 | Bordner et al. | |
| 5,713,482 | A | 2/1998 | Bordner et al. | |
| 5,785,201 | A | 7/1998 | Bordner et al. | |
| 5,947,320 | A | 9/1999 | Bordner et al. | |
| 6,126,213 | A * | 10/2000 | Jones et al. | 292/256.6 |
| 6,712,542 | B2 * | 3/2004 | Buder | 403/374.2 |

* cited by examiner

*Primary Examiner*—Brian E. Glessner
*Assistant Examiner*—Mark Williams
(74) *Attorney, Agent, or Firm*—Wood, Phillips, Katz, Clark & Mortimer

(57) ABSTRACT

A locking belt is used with a container having an annular end portion defining a top opening and a removable cover overlying the opening. The locking belt comprises a split circular ring, generally U-shaped in cross section, having first and second ends and including an outer circumferential wall. A through opening is in the outer circumferential wall proximate the fist end. An arm extends outwardly from the outer circumferential wall proximate the second end to define a notch opening away from the second end. A lever arm has a near end and a distal end. The lever arm comprises an arcuate handle having sides proximate the near end to be received in the split circular ring and includes a tongue connected between the sides and extending outwardly from the near end. A connecting strap is provided for integrally connecting the split circular ring second end and the lever arm. The ring, the connecting strap and the lever arm are of one piece plastic construction. In use, the lever arm is threaded through the through opening so the connecting strap is received in the through opening and the tongue is received in the notch with the lever arm overlying the split circular ring at the second end to retain the cover on the container.

20 Claims, 6 Drawing Sheets

ONE PIECE LOCKING BELT

FIELD OF THE INVENTION

This invention relates to containers and, more particularly, to a one piece plastic locking belt for securing a cover to a container.

BACKGROUND OF THE INVENTION

In one form of conventional shipping and storage container, in the form of a drum, a tubular side wall is formed of fibrous material or other material. It is conventional to provide connecting rings at opposite ends of the sidewall for securing closures thereacross. The connecting rings may be of metal or plastic. Alternatively, the drum may be of one piece plastic construction, such as made by blow molding.

In one form of a container closure, a removable cover is configured to rest on the annular connecting ring at the top of the container. A locking belt secures the cover to the retaining ring. The locking belt most commonly has been formed of metal and includes metal locking structure riveted thereto. Such a metal locking band can be expensive and might also rust, which could contaminate the product stored in the container. Locking belts have also been formed of plastic. The plastic locking belts are formed of multiple plastic pieces. This requires that the multiple pieces be molded or otherwise formed separately.

The present invention is directed to solving one or more of the problems discussed above in a novel and simple manner.

SUMMARY OF THE INVENTION

In accordance with the invention, there is disclosed a locking belt of one piece plastic construction.

Broadly, there is disclosed a locking belt for use with a container having an annular end portion defining a top opening and a removable cover overlying the opening. The locking belt comprises a split circular ring, generally U-shaped in cross section, having first and second ends and including an outer circumferential wall. A through opening is in the outer circumferential wall proximate the fist end. An arm extends outwardly from the outer circumferential wall proximate the second end to define a notch opening away from the second end. A lever arm has a near end and a distal end. The lever arm comprises an arcuate handle having sides proximate the near end to be received in the split circular ring and includes a tongue connected between the sides and extending outwardly from the near end. Connecting means are provided for integrally connecting the split circular ring second end and the lever arm comprising the ring, the connecting means and the lever arm being of one piece plastic construction. In use, the lever arm is threaded through the through opening so the connecting means is received in the through opening and the tongue is received in the notch with the lever arm overlying the split circular ring at the second end to retain the cover on the container.

It is a feature of the invention that the tongue comprises a bifurcated tongue defining a slot and the notch includes a web received in the slot.

It is another feature of the invention that the through opening is rectangular.

It is another feature of the invention that the connecting means comprises a strap connected tangentially to the outer circumferential wall and to the handle. The strap may connect to the handle inwardly from the near end.

It is a further feature of the invention that the connecting means comprises a rod element connected to the lever arm.

In accordance with another aspect of the invention locking structure is operatively associated with the split circular ring and the lever arm for retaining the lever arm overlying the split circular ring.

It is a feature of the invention that the locking structure comprises a hook extending outwardly from the outer circumferential wall spaced from the arm and received in an opening in the handle. The hook may include a through bore and the handle may include a projection having a whole aligned with the through bore.

It is another feature of the invention that the handle includes a rib along an edge of the through opening for engaging the hook.

There is disclosed in accordance with another aspect of the invention a one piece plastic locking belt for use with a containing having an annular end portion defining a top opening and a removable cover overlying the opening. The locking belt comprises a split circular ring defining a channel, including an outer circumferential wall, for retaining the cover on the container. The ring has first and second ends, a through opening in the outer circumferential wall proximate the first end and an arm extending outwardly from the outer circumferential wall proximate the second end to define a notch opening away from the second end. A lever arm has a near end and a distal end. The lever arm comprises an arcuate handle having sides proximate the near end to be received on the split circular ring and a tongue connected between the sides and extending outwardly from the near end. An elongate strap is between the split circular rings second end and the lever arm. In use, the lever arm is threaded through the through opening so the strap is received in the through opening and the tongue is received in the notch at the lever arm overlying the split circular ring at the second end to retain the cover on the container.

Further features and advantages of the invention will be readily apparent from the specification and from the drawings.

DETAILED DESCRIPTION OF THE INVENTION

Figure 1:
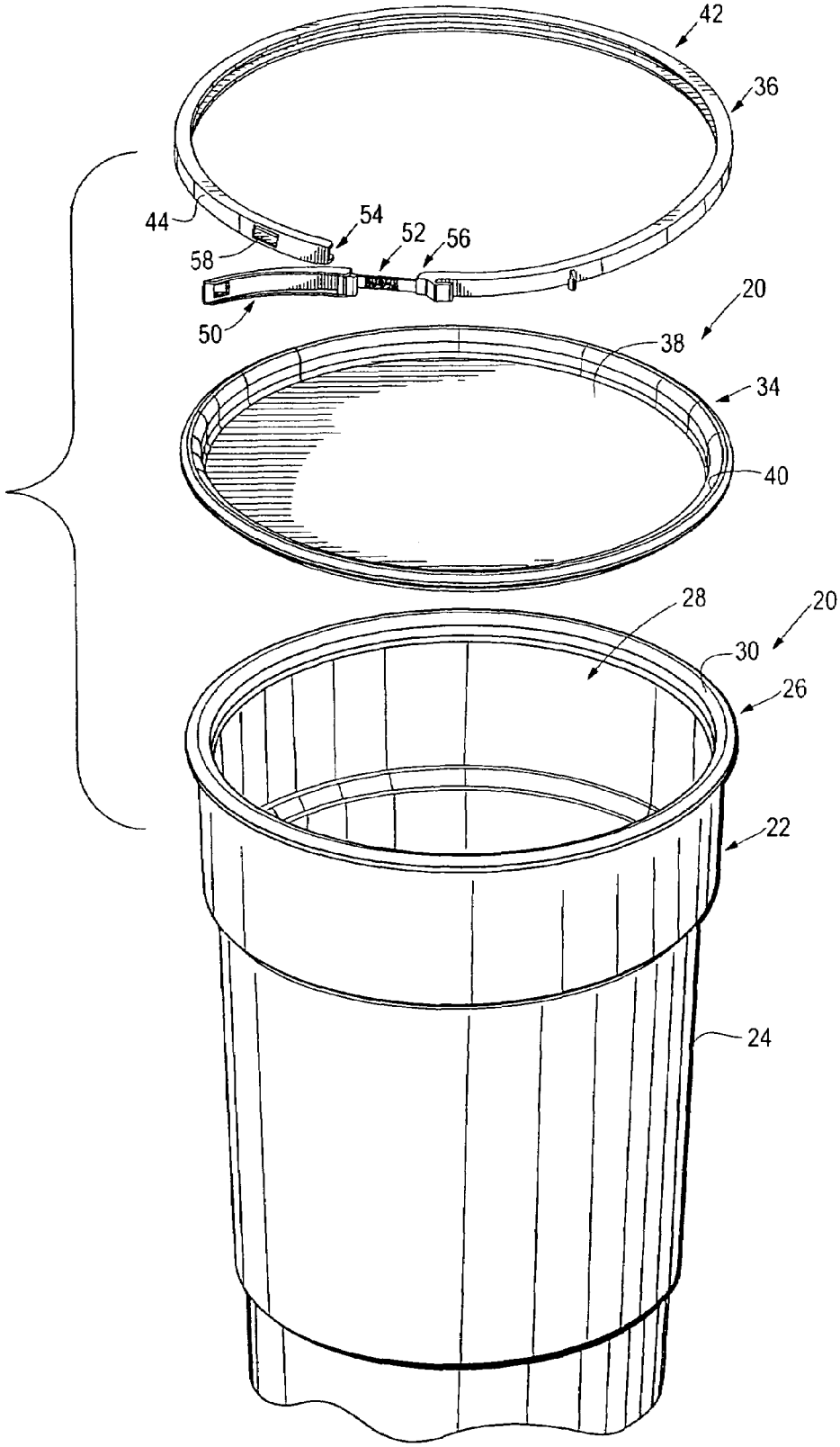
FIG. 1 is an exploded perspective view of a container including a drum, cover and locking belt in accordance with the invention.
Figure 10:
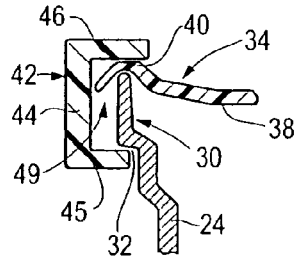
FIG. 10 is a sectional view taken along the line 10—10 of FIG. 8.

In the illustrated embodiment of the invention, as shown in FIG. 1, a container 20 includes a drum 22 having a tubular side wall 24 closed at a bottom by a bottom wall (not shown) and having an annular end portion 26 defining a top opening 28. The annular end portion 26 comprises a connecting ring in the form of a chime 30. In the illustrated embodiment of the invention, the drum 20 is of one piece molded plastic construction such as may be formed by blow molding. Referring also to FIG. 10, the chime 30 defines an annular shoulder 32.

As an alternative to a one piece plastic drum, the drum 22 may be formed of other materials such as a conventional fibrous tube side wall having a metal or plastic connecting ring defining a radially outwardly opening annular recess to define a shoulder similar to the shoulder 32.

The top opening 28 is selectively closed by a cover or closure 34 secured to the chime 30 using a locking belt 36 according to the invention. The closure 34 is of unitary construction and in the illustrated embodiment is injection molded of suitable synthetic resin. The closure 34 includes a generally circular top wall 38 surrounded by a downwardly opening U-shaped flange 40. When the closure 34 is seated on the chime 30, the chime 30 is received in the flange 40, as illustrated in FIG. 10.

The locking belt 36 includes a split circular ring 42. The split circular ring 42 is generally U-shaped in cross section, as shown in FIG. 10, including an outer circumferential wall 44 separating an upper wall portion 46 and a lower wall portion 48. The U-shaped split circular ring 42 defines a channel 49. In use, the outer circumferential wall 44 extends around the closure 34 with the lower wall portion 48 engaging the drum shoulder 32 and the upper wall portion 46 projecting radially inwardly above the closure flange 40 to retain the closure 34 on the drum 20. Particularly, the upper wall portion 46 and the chime 30 sandwich the flange 40.

The locking belt 36 also includes a lever arm 50 and a connecting strap 52. In accordance with the invention, the split circular ring 42, the lever arm 50 and connecting strap 52 are of one piece plastic construction. More particularly, the locking belt 36 is injection molded of synthetic resin such as high load melt index (HLMI) resin. It is molded in a generally circular configuration, as illustrated in FIG. 1.

Figure 2:
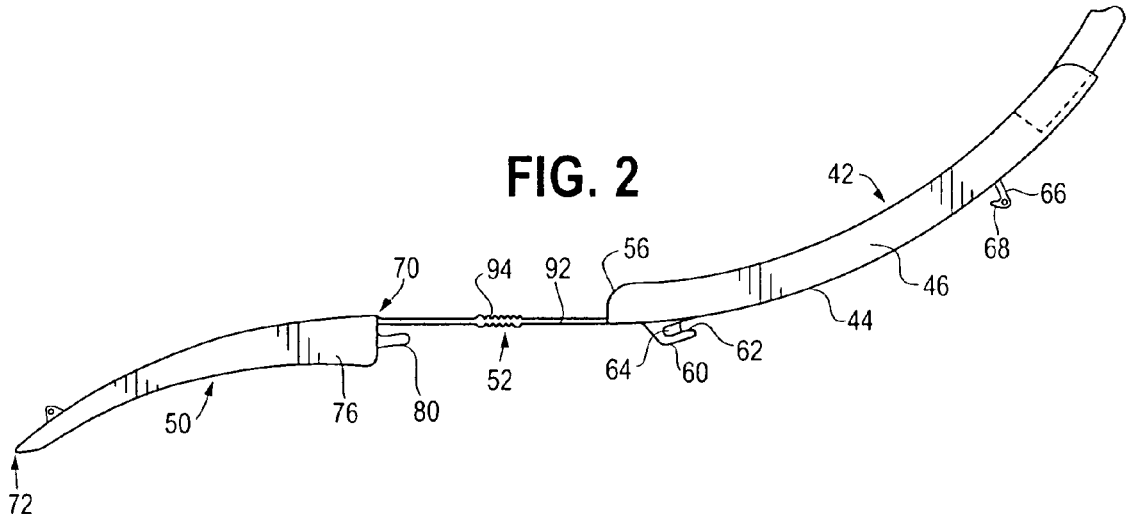
FIG. 2 is a cutaway plan view of the locking belt of FIG. 1.
Figure 3:
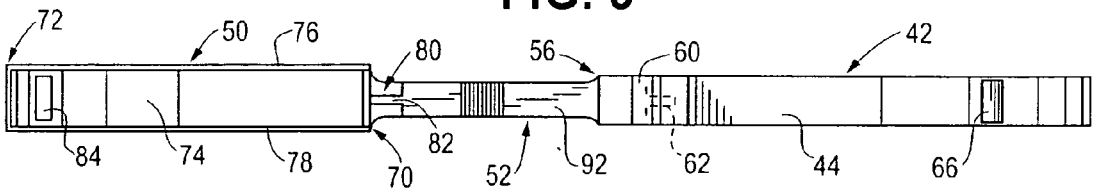
FIG. 3 is a front elevation view of the cutaway portion of the locking belt of FIG. 2.
Figure 4:
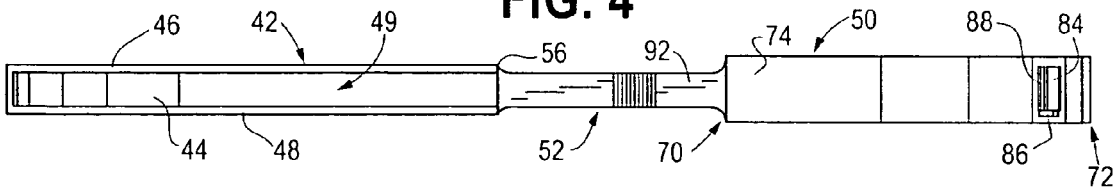
FIG. 4 is a rear elevation view of the cutaway portion of the locking belt of FIG. 2.

The split circular ring 42 has a first end 54 and a second end 56. Circumference of the ring 42 between the first end 54 and the second end 56 is less than the circumference of the closure flange 40. A rectangular through opening 58 is provided in the outer circumferential wall 44 proximate the first end 54. With reference also to FIGS. 2-4, an arm 60 extends outwardly from the outer circumferential wall 44 proximate the second end 56. The arm 60 define a notch 62 opening away from the second end 56. A web 64 is disposed in the notch 62 between the outer circumferential wall 44 and the inner side of the arm 60.

A hook 66 extends outwardly from the outer circumferential wall 44 and is spaced from the arm 60 opposite the second end 56. A through bore 68 extends transversely through the hook 66. The hook 66 faces in a direction toward the arm 60, as is particularly illustrated in FIG. 2.

The lever arm 50 has a near end 70 and a distal end 72. The lever arm 50 includes an arcuate handle 74 having sides 76 and 78. In the illustrated embodiment of the invention, the sides 76 and 78 extend from the near end 70 to the distal end 72 and are wider at the near end 70. The sides 76 and 78 need not extend all the way from the near end 70 to the distal end 72.

A tongue 80 is connected between the sides 76 and 78 and extends outwardly from the near end 70 toward the circular ring second end 56, as shown in FIG. 2. The tongue 80 includes a central slot 82 to define a bifurcated tongue.

An opening 84 is provided in the handle 74 proximate the distal end 72, as shown in FIG. 3. The opening 84 is generally rectangular in shape and is of a size to receive the hook 66. A projection 86 extends outwardly from the handle 74 on one side of the opening 84. A rib 88 extends transversely on the handle 74 adjacent an edge of the opening 84 closest to the near end 70. The projection 86 includes a hole 90, see FIG. 7.

The connecting strap 52 is provided to connected the circular ring second end 56 and the lever arm near arm 70. Particularly, the connecting strap 72 comprises an elongate strap 92 having a ribbed central portion 94. The strap 92 is substantially coplanar with the outer circumferential wall 44 at the second end 56 and is substantially coplanar with the handle 74 at the near end 70, see FIG. 4. The ribs 94 enhance flexibility of the strap 92 and aid in restricting movement of the locking belt 36 when installed as described below.

Figure 5:
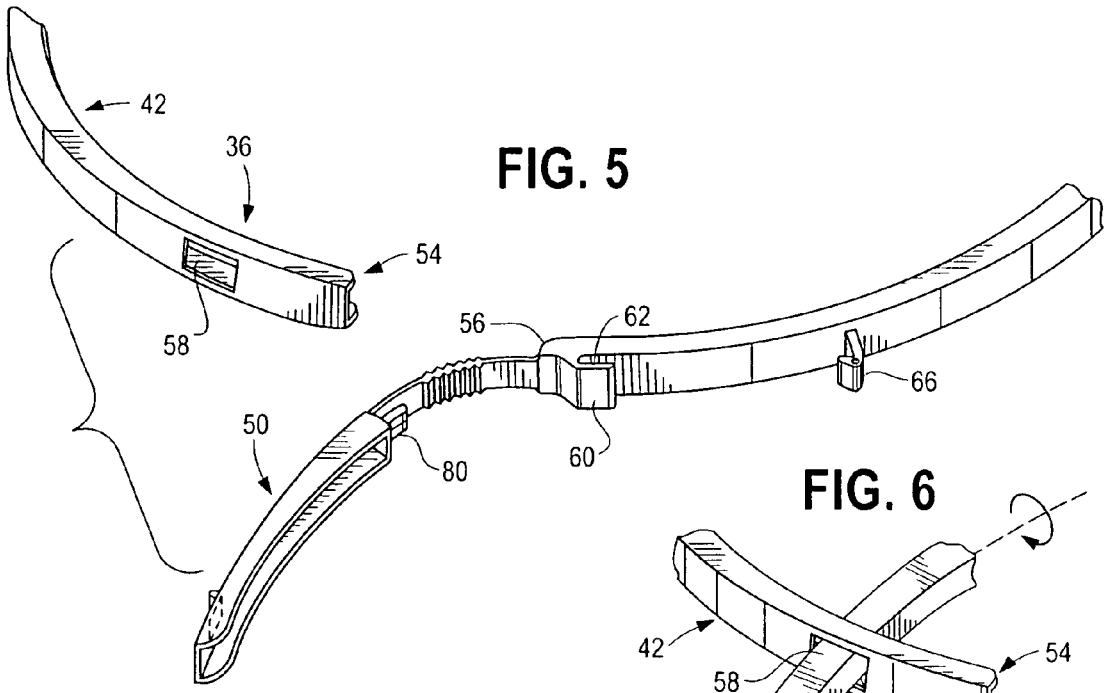
FIG. 5 is a cutaway view illustrating the locking belt of FIG. 1 prior to installation.
Figure 6:
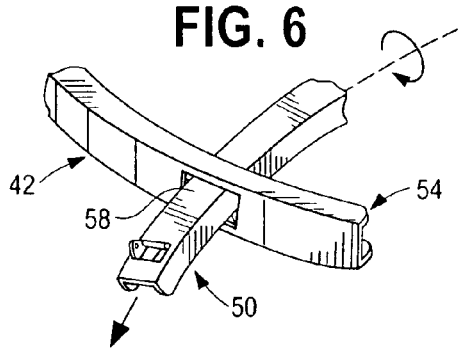
FIG. 6 is a partial perspective view illustrating threading of a lever arm of the locking belt of FIG. 1 through an opening in the split circular ring of the locking belt.
Figure 7:
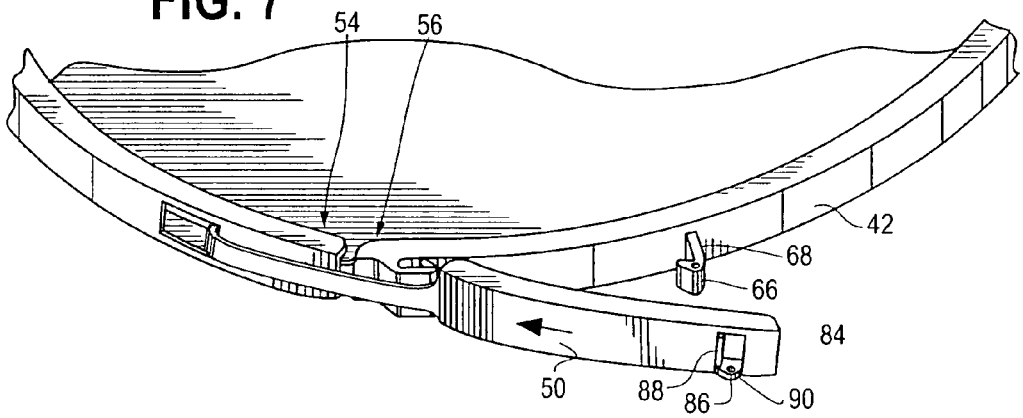
FIG. 7 is a partial perspective view illustrating toggling of the lever arm of FIG. 6.
Figure 8:
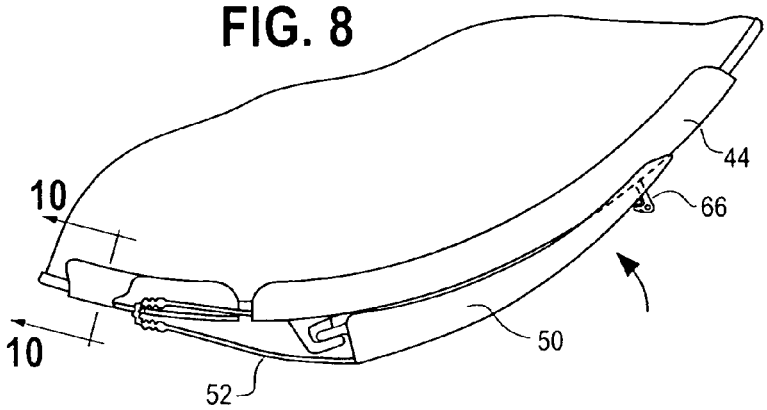
FIG. 8 is a cutaway plan view, partially in section, illustrating the locking belt of FIG. 1 retaining the cover on the container.
Figure 9:
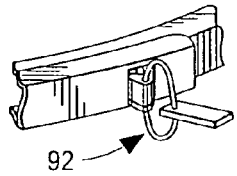
FIG. 9 is a partial perspective view illustrating a locking element for retaining the locking belt of FIG. 1 in a locked position.

FIGS. 5–9 illustrate a sequence used for installing the locking belt 36 onto the drum 26 and closure 34. Initially, the split circular ring 42 is placed around the closure 34 and chime 30, as generally in FIG. 10, with the first end 54 and second end 56 spaced as generally indicated in FIG. 5 and the lever arm 50 away from the drum. Thereafter, and with reference to FIG. 6, the first end 54 is pulled away so that the lever arm 50 can be turned and inserted through the through opening 58, as illustrated in FIG. 6. Next, the strap 92 is bent about 180 degrees, as illustrated in FIG. 7, and the lever arm 50 is drawn in the direction toward the second end 56 which draws the first end 54 and the second end 56 together. The tongue 80 is then positioned in the notch 62, with the slot 82 receiving the web 62. The lever arm 50 is then be toggled down toward the circular ring 42, as illustrated by the arrow in FIG. 8 so that the hook 66 is received in the through opening 84 and latches on the rib 88. Additionally, the spacing between the lever arm sides 76 and 78 is greater than spacing between the circular ring upper portion 46 and lower portion 48 to be received thereon, as shown in FIG. 8. The hook 66 maintains the lever arm 50 in a locked position. Thereafter, a locking element 92, see FIG. 9, can be threaded through the hook bore 68 and the projection opening 90 to secure the locking belt 36.

Thus, in accordance with the invention, a one piece locking band of plastic construction secures the closure 34 on the drum 22 to provide an effective shipping and storage container 20.

Figure 11:
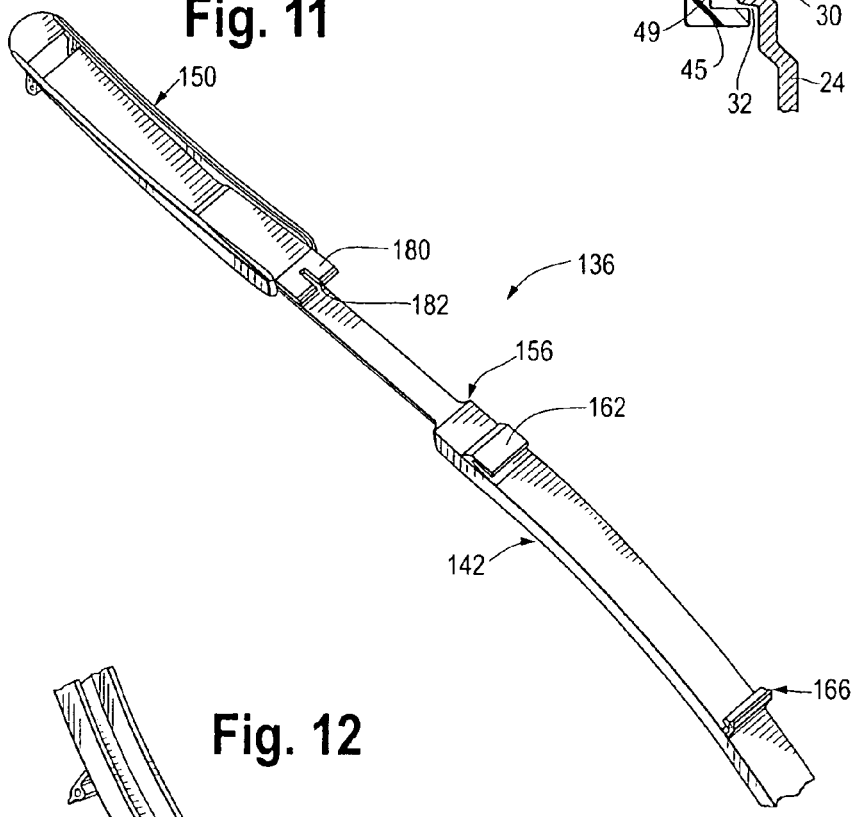
FIG. 11 is a front, partial perspective view of a locking belt according to a second embodiment of the invention.
Figure 12:
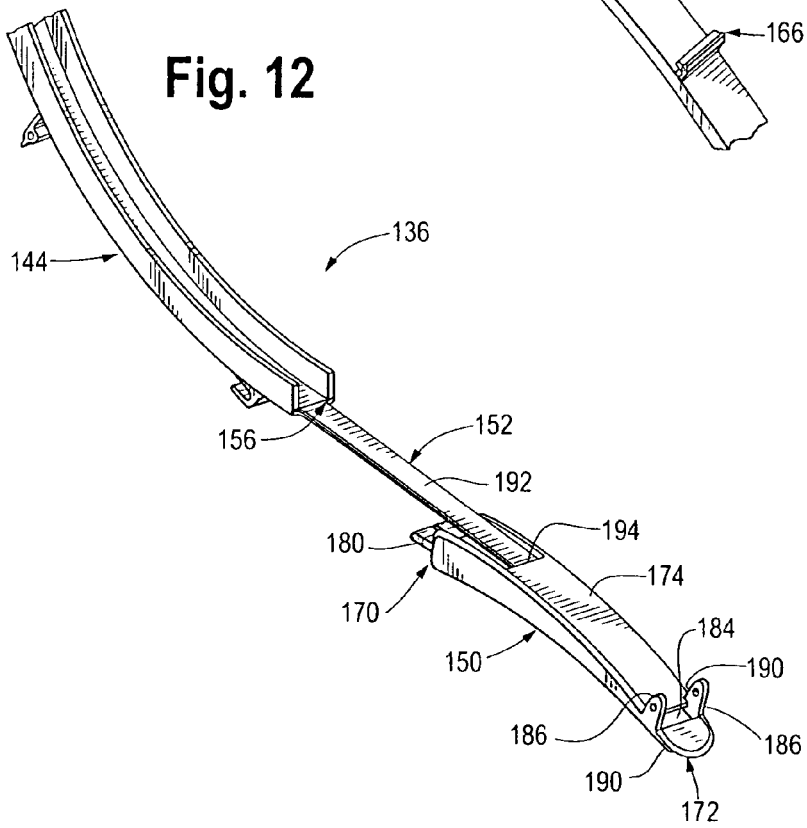
FIG. 12 is a rear perspective view of the portion of the locking belt illustrated in FIG. 11.
Figure 14:
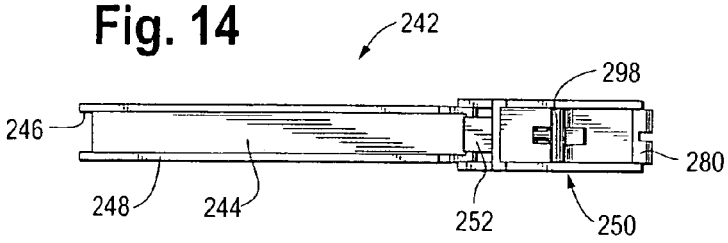
FIG. 14 is a front elevation view of the portion of the locking belt illustrated in FIG. 13.
Figure 13:
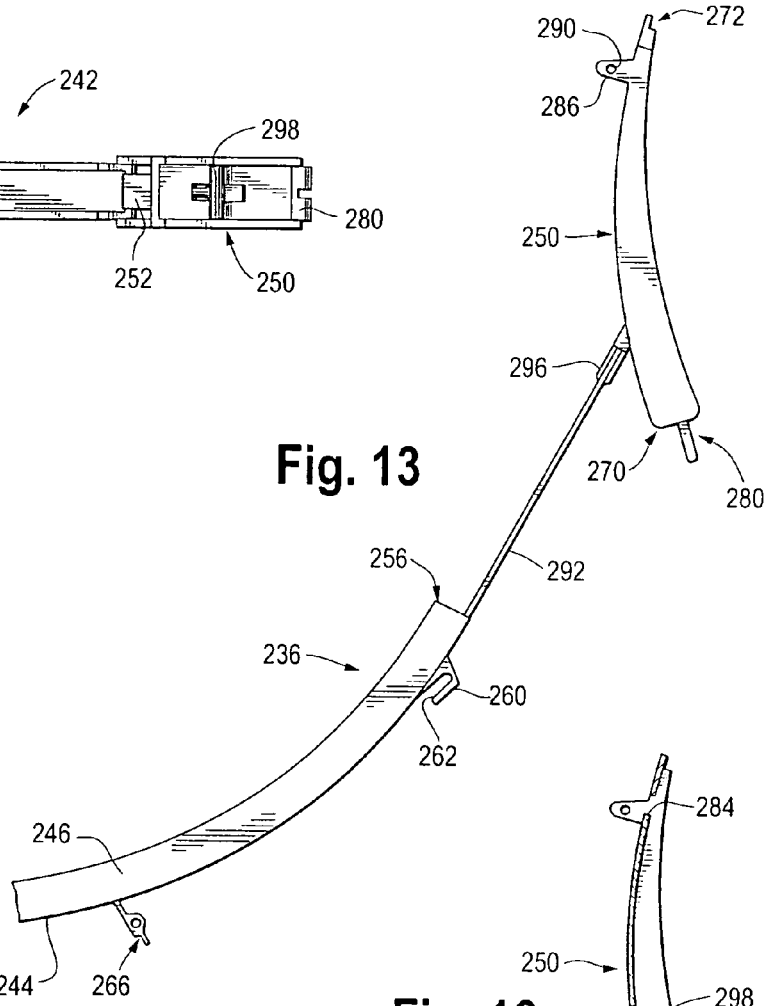
FIG. 13 is a top, partial plan view of a portion of a locking belt according to a third embodiment of the invention.
Figure 15:
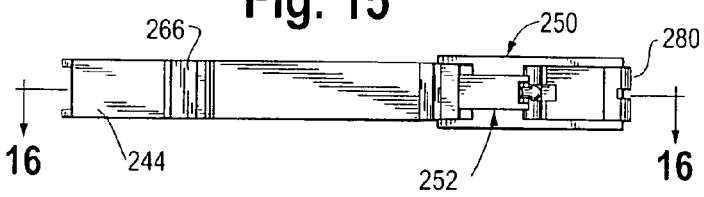
FIG. 15 is a rear elevation view of the portion of the locking belt illustrated in FIG. 13.
Figure 16:
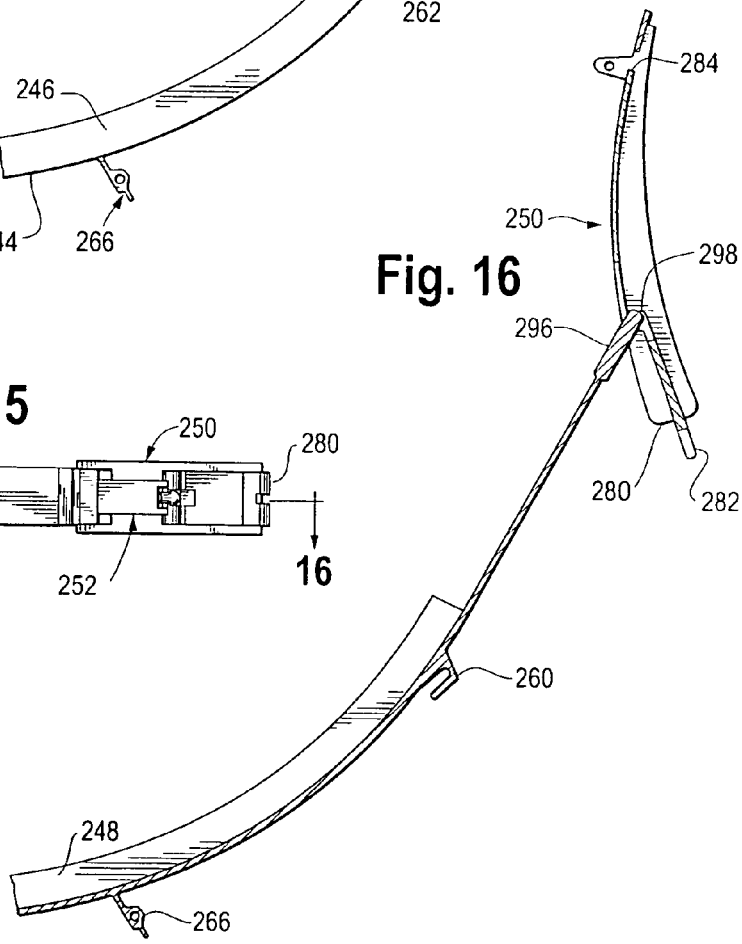
FIG. 16 is a sectional view taken along the line 16—16 of FIG. 15.
Figure 17:
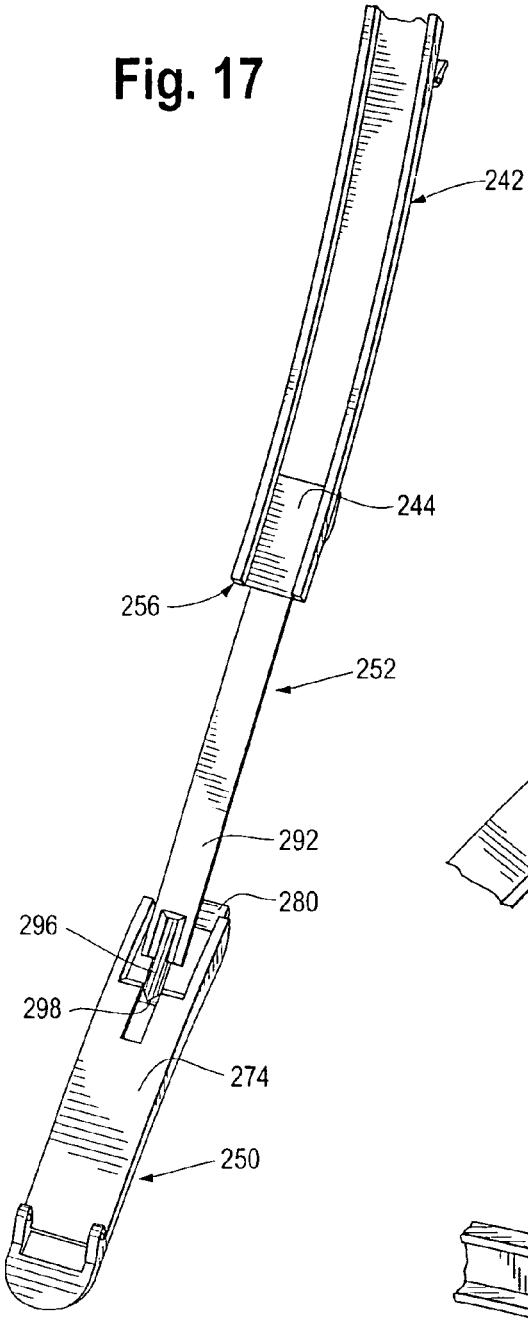
FIG. 17 is a rear partial perspective view of the locking belt of FIG. 13.
Figure 18:
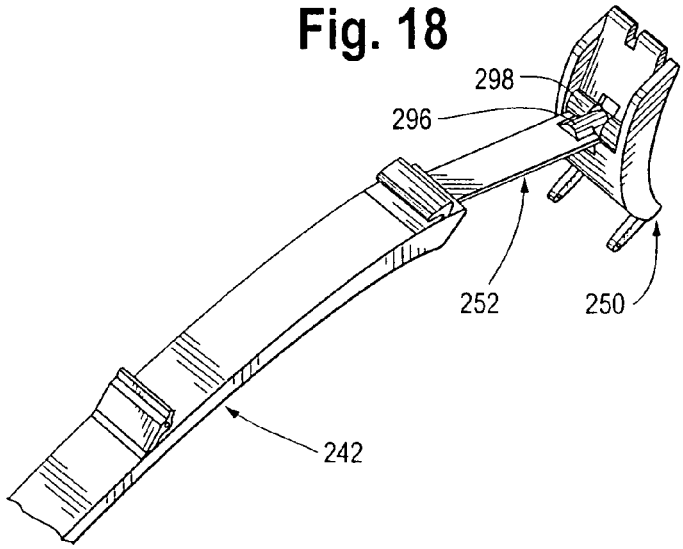
FIG. 18 is a front partial perspective view of the portion of the locking belt of FIG. 13.
Figure 19:
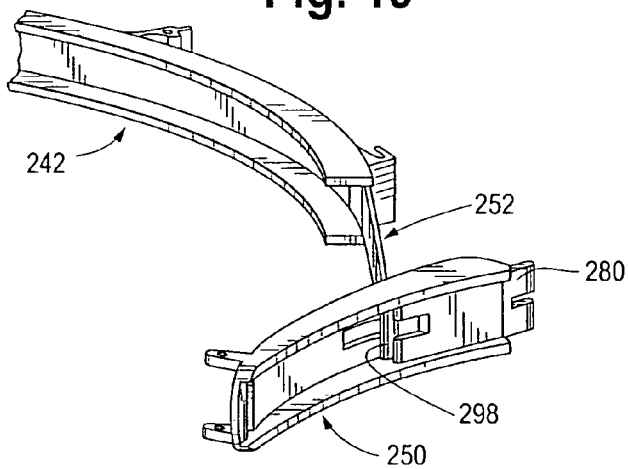
FIG. 19 is an end perspective view of the partial portion of the locking belt of FIG. 13.

FIGS. 11 and 12 illustrate a portion of a locking belt 136 in accordance with a second embodiment of the invention. For simplicity, elements similar to those in the embodiment of FIGS. 1–10 are illustrated with similar reference numerals with a prefix 1. In other words reference numeral 136 corresponds to previously described reference numeral 36. Likewise, for simplicity only the portion of the split circular ring proximate the second end 156 is illustrated as the remainder of the split circular ring is identical in this embodiment.

The one piece locking belt 136 of FIGS. 11 and 12 differs from the locking belt 36 of FIG. 1 in that the lever arm 150 includes a handle 174 which ends short of the near end 70. The connecting member 152 comprises a longer strap 192 which connects to the handle 174 as at a location 194 spaced from the near end 170. Similarly, there is no rib proximate the opening 184 and the handle includes two projections 186 on either side of the opening 184 each including a hole 190.

The locking belt 136 is secured generally similar to the locking belt 36 discussed above. The longer strap 192 allows for greater flexibility in toggling the lever arm 150 into the secure position.

Referring to FIGS. 13–19, a one piece locking belt 236 according to still another embodiment of the invention is illustrated. As with the second embodiment, the entire circular ring is not illustrated as it is identical to that discussed above relative to FIG. 1. For simplicity, like elements are illustrated with similar reference numerals with a prefix 2. For example, the reference number 36 of FIG. 1 corresponds to reference number 236 of FIG. 2. Where the elements are similar, they are not discussed in detail relative to the embodiment of FIGS. 13–19.

The locking belt 236 is generally similar to the locking belt 36 but differs principally in the connection between the connecting element 252 and the lever arm 250. The connecting element 252 includes an elongate strap 292 connected to the outer circumferential wall 244 proximate the second end 256. A rod element 296 is connected between the strap 292 and a shaft 298 on an underside of handle 274. As is apparent, the rod element 296 and shaft 298 are integrally formed as the locking belt 236 is of one piece molded plastic construction. The inner connection between the rod element 296 and the shaft 298 enhances flexibility of the lever arm 250 relative to the split circular ring 242 for threaded the lever arm 250 through the through opening, similar to the through opening 58, see FIG. 1, when installing the locking belt 236. In other respects, the locking belt 236 is similar to that discussed above relative to the first few embodiments.

Thus, in accordance with the invention, there is described multiple embodiments for a one piece plastic locking belt used for securing a closure to a drum to form a shipping and storage container. The use of a one piece locking belt minimizes the number of parts required to be molded and simplifies reusability and storage.

I claim:

1. A locking belt for use with a container having an annular end portion defining a top opening and a removable cover overlying said opening, comprising:

a split circular ring, generally U-shaped in cross section, having first and second ends and including an outer circumferential wall, a through opening in the outer circumferential wall proximate the first end and an arm extending outwardly from the outer circumferential wall proximate the second end to define a notch opening away from the second end;

a lever arm having a near end and a distal end, the lever arm comprising an arcuate handle having sides proximate the near end to be received on the split circular ring, and including a tongue connected between the sides and extending outwardly from the near end; and connecting means for integrally connecting the split circular ring second end and the lever arm comprising the ring, the connecting means and the lever arm being of one piece plastic construction, wherein, in use, the lever arm is threaded through the through opening so the connecting means is received in the through opening and the tongue is received in the notch with the lever arm overlying the split circular ring at the second end to retain the cover on the container.

2. The locking belt of claim 1 wherein the tongue comprises a bifurcated tongue defining a slot and the notch includes a web received in the slot.

3. The locking belt of claim 1 wherein the through opening is rectangular.

4. The locking belt of claim 1 wherein the connecting means comprises a strap connected tangentially to the outer circumferential wall and to the handle.

5. The locking belt of claim 4 wherein the strap connects to the handle inwardly from the near end.

6. The locking belt of claim 1 wherein the connecting means comprises a rod element connected to the lever arm.

7. The locking belt of claim 1 further comprising locking structure operatively associated with the split circular ring and the lever arm for retaining the lever arm overlying the split circular ring.

8. The locking belt of claim 7 wherein the locking structure comprises a hook extending outwardly from the outer circumferential wall spaced from the arm and received in an opening in the handle.

9. The locking belt of claim 8 wherein the hook includes a through bore and the handle includes a projection having a hole aligned with the through bore.

10. The locking belt of claim 8 wherein the handle includes a rib along an edge of the through opening for engaging the hook.

11. A one piece plastic locking belt for use with a container having an annular end portion defining a top opening and a removable cover overlying said opening, comprising:

a split circular ring defining a channel, including an outer circumferential wall, for retaining the cover on the container and having first and second ends and, a through opening in the outer circumferential wall proximate the first end and an arm extending outwardly from the outer circumferential wall proximate the second end to define a notch opening away from the second end;

a lever arm having a near end and a distal end, the lever arm comprising an arcuate handle having sides proximate the near end to be received on the split circular ring, and including a tongue connected between the sides and extending outwardly from the near end; and an elongate strap between the split circular ring second end and the lever arm, wherein, in use, the lever arm is threaded through the through opening so the strap is received in the through opening and the tongue is received in the notch with the lever arm overlying the split circular ring at the second end to retain the cover on the container.

12. The locking belt of claim 11 wherein the tongue comprises a bifurcated tongue defining a slot and the notch includes a web received in the slot.

13. The locking belt of claim 11 wherein the through opening is rectangular.

14. The locking belt of claim 11 wherein the strap is connected tangentially to the outer circumferential wall and to the handle.

15. The locking belt of claim 14 wherein the strap connects to the handle inwardly from the near end.

16. The locking belt of claim 11 wherein the strap is connected via a rod element to the lever arm.

17. The locking belt of claim 11 further comprising locking structure operatively associated with the split circular ring and the lever arm for retaining the lever arm overlying the split circular ring.

18. The locking belt of claim 17 wherein the locking structure comprises a hook extending outwardly from the outer circumferential wall spaced from the arm and received in an opening in the handle.

19. The locking belt of claim 18 wherein the hook includes a through bore and the handle includes a projection having a hole aligned with the through bore.

20. The locking belt of claim 18 wherein the handle includes a rib along an edge of the through opening for engaging the hook.

* * * * *